United States Patent [19]

Tolasch et al.

[11] 4,364,462

[45] Dec. 21, 1982

[54] APPARATUS FOR TRANSPORT AND TEMPORARY STORAGE OF CIGARETTES OR THE LIKE BETWEEN PRODUCING AND PROCESSING MACHINES

[75] Inventors: Gerhard Tolasch; Hans J. Grasse, both of Wentorf, Fed. Rep. of Germany

[73] Assignee: Hauni-Werke Körber & Co. K.G., Hamburg, Fed. Rep. of Germany

[21] Appl. No.: 194,600

[22] Filed: Oct. 6, 1980

Related U.S. Application Data

[63] Continuation of Ser. No. 878,615, Feb. 16, 1978, abandoned.

[30] Foreign Application Priority Data

Dec. 30, 1977 [DE] Fed. Rep. of Germany ..... 2758863

[51] Int. Cl.[3] ..... B65G 1/00

[52] U.S. Cl. ..... 198/347; 198/572

[58] Field of Search ..... 198/347, 571–573, 198/575, 577, 579, 855–857; 131/282, 283, 909; 53/493

[56] References Cited

U.S. PATENT DOCUMENTS

| | | | |
|---|---|---|---|
| 3,297,138 | 1/1967 | McCombie | 53/493 |
| 4,078,647 | 3/1978 | David et al. | 198/347 |
| 4,099,608 | 7/1978 | McCombie | 198/572 |

*Primary Examiner*—Joseph E. Valenza

*Attorney, Agent, or Firm*—Kontler, Grimes & Battersby

[57] ABSTRACT

Apparatus for transporting cigarettes or analogous rod-shaped articles from one or more makers to a packing machine has a transporting system consisting of belt conveyors and one or more ducts which advance the output of the makers into the inlet of an upright channel serving to deliver the cigarettes to the packing machine. When the output of the makers exceeds the requirements of the packing machine, the surplus is diverted from the discharge end of the transporting system into one or more variable-volume surge bins by way of a reservoir wherein the height of the cigarette stream exceeds the height of the stream in the transporting system but is less than the height of the stack or stacks of cigarettes in the surge bin or bins. The reservoir has one or more conveyors which can advance cigarettes from the transporting system into the surge bin(s) or from the surge bin(s) into the channel. The direction of movement of the conveyor or conveyors in the reservoir is determined by a sensor which rests on the topmost layer of cigarettes at the discharge end of the transporting system, and the volume of each surge bin is varied by a sensor which rests on the uppermost layer of cigarettes in the transfer zone between the reservoir and the surge bin or bins.

7 Claims, 7 Drawing Figures

II
VZ1

477
482'
456'
VZ3
454'
453'
456
482
454
452
453
302
304a
304
306
VZ1
308
309
314
316
51
VZ2
373
347a'
381
347c'
52
371'
VZ3
377
382
371
347c
352
354
353
356
S3
52
347b
347a
346
M
P

APPARATUS FOR TRANSPORT AND TEMPORARY STORAGE OF CIGARETTES OR THE LIKE BETWEEN PRODUCING AND PROCESSING MACHINES

This is a continuation, of application Ser. No. 878,615, filed Feb. 16, 1978, now abandoned.

BACKGROUND OF THE INVENTION

The present invention relates to apparatus for manipulating cigarettes, cigars, cigarillos (with or without filter tips), filter rod sections and analogous rod-shaped articles which constitute or form part of smokers' products. More particularly, the invention relates to improvements in apparatus for manipulating rod-shaped articles of the above outlined character (hereinafter called cigarettes for short) between one or more producing machines (e.g., makers of plain cigarettes or filter cigarette making machines) and one or more consuming or processing machines (e.g., packing machines). Still more particularly, the invention relates to improvements in apparatus which can compensate for variations in requirements of one or more variable-capacity processing or consuming machines and for variations in the output of one or more variable-capacity producing machines by embodying or by cooperating with a facility for temporary storage of the surplus between the producing and processing machines.

It is already known to provide one or more reservoirs between the outlet of a producing machine and the inlet of a processing machine, and to design the reservoir or reservoirs in such a way that they can store several layers of cigarettes, normally a number of layers slightly or greatly exceeding the number of layers in the stream of cigarettes which is transported from the producing machine to the processing machine. Reference may be had, for example, to commonly owned copending application Ser. No. 130,391 filed Mar. 14, 1980 by Horst Bäse et al. (the application Ser. No. 130,391 is a continuation of Ser. No. 006,223 filed Jan. 24, 1979, now abandoned, and the application Ser. No. 006,223 is a continuation of Ser. No. 804,332 filed June 7, 1977 and now abandoned), and to commonly owned copending application Ser. No. 130,392 filed Mar. 14, 1980 by Gerhard Tolasch et al. (the application Ser. No. 130,392 is a continuation of Ser. No. 006,221 filed Jan. 24, 1979, now abandoned, and the application Ser. No. 006,221 is a continuation of Ser. No. 804,338 filed June 7, 1977 and now abandoned). Reference may further be had to commonly owned applications Ser. Nos. 804,305, 804,333 and 804,337, all filed June 7, 1977 by Gerhard Tolasch et al. and now abandoned. As a rule, the cigarettes which issue from one or more producing machines or makers are transported in the form of a multi-layer stream whose height is a fraction of the height of the stack of cigarettes in the reservoir. A channel (e.g., a duct) is provided to normally deliver the multi-layer stream of cigarettes to the magazine or magazines of one or more processing machines. When the processing machine(s) cannot accept the entire output of the producing machine(s), e.g., because one or more processing machines are out of commission, the multi-layer stream is introduced into the reservoir of reservoirs whereby the height of such stream increases to match the level of the stack of cigarettes in the reservoir(s). If the requirements of the processing machine(s) cannot be satisfied by the momentary output of the producing machine(s), the reservoir or reservoirs are caused to discharge their contents to supplement the output of the producing machine(s).

It has been found that cigarettes are likely to be damaged (especially defaced or crushed) during introduction into a reservior wherein the height of the stack exceeds the maximum height of the cigarette stream. Furthermore, the cigarettes are likely to change their orientation during expulsion or removal from the reservoir(s) for introduction into the processing machine(s) in the event of a breakdown or slowdown of one or more producing machines.

OBJECTS AND SUMMARY OF THE INVENTION

An object of the invention is to provide a novel and improved apparatus which can be utilized for transport and temporary storage of cigarettes or analogous rod-shaped articles between one or more producing machines and one or more processing machines, and which is constructed and assembled in such a way that its components are not likely to damage and/or deface the articles.

Another object of the invention is to provide an apparatus wherein the height of the stack in the reservior or reservoirs does not affect the condition of articles which are moved into, temporarily stored in or moved out of the reservoir(s), even if the contents of the reservoir(s) are changed at frequent intervals and even if the height of the article stream which is fed into or withdrawn from the reservoir(s) is a small fraction of the height of the stacked articles.

A further object of the invention is to provide novel and improved means for conveying the articles in an apparatus of the above outlined character.

An additional object of the invention is to provide the apparatus with novel and improved means for preventing undesirable accumulations of articles on their way from the producing machine(s) to the processing machine(s) and/or to the reservoir(s).

A further object of the invention is to provide the apparatus with novel and improved facilities for temporary storage of articles in the event of a slowdown or malfunctioning of the processing machine(s).

An ancillary object of the invention is to provide the apparatus with novel and improved means for preventing undesirable changes in orientation of articles in or close to the storage facilities.

An additional object of the invention is to provide a novel and improved combination of reservoirs for use in the above outlined apparatus.

The invention is embodied in an apparatus for transporting cigarettes or analogous rod-shaped articles which constitute or form part of smokers' products from at least one variable-capacity producing machine (e.g., one or more cigarette makers whose output may fluctuate within a wide range) to at least one variable-capacity processing or consuming machine (e.g., one or more packing machines whose requirements also fluctuate within a wide range). The apparatus comprises (a) means for transporting a multi-layer stream of articles (the articles are moved sideways) from the producing machine along a first path having a discharge end and a first height (i.e., the maximum number of layers which form the stream does not or normally does not exceed a certain value), (b) a channel or an analogous conveying device having a receiving end or inlet at the discharge end of the first path and defining a second path for delivery of articles of the multi-layer stream to the processing machine (the dimensions of the conveying device are preferably selected in such a way that it can deliver articles in the form of a multi-layer stream), (c) at least one first reservoir which preferably constitutes a variable-volume surge bin having a second height which exceeds the height of the multi-layer stream in the first path and further having a first inlet-outlet opening for admission of articles into and for evacuation of articles from the interior of the surge bin, and (d) a second or intermediate reservoir communicating with the opening of the surge bin and having a second inlet-outlet opening adjacent to the first path (preferably adjacent to the discharge end of the first path and to the receiving end of the aforementioned conveying device). The intermediate reservoir has a third height which is less than the (second) height of the stack of articles in the surge bin, and the intermediate reservoir includes means for conveying articles from the surge bin to the first path for introduction into the receiving end of the conveying device (preferably directly into the receiving end of the conveying device) when the requirements of the processing machine exceed the output of the producing machine and for conveying articles from the first path (preferably from the discharge end of the first path) into the surge bin when the output of the producing machine exceeds the requirements of the processing machine.

The conveying device preferably extends downwardly from its receiving end and the transporting means preferably includes at least one driven endless flexible conveyor which is horizontal or nearly horizontal, at least in the region of the discharge end of the first path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
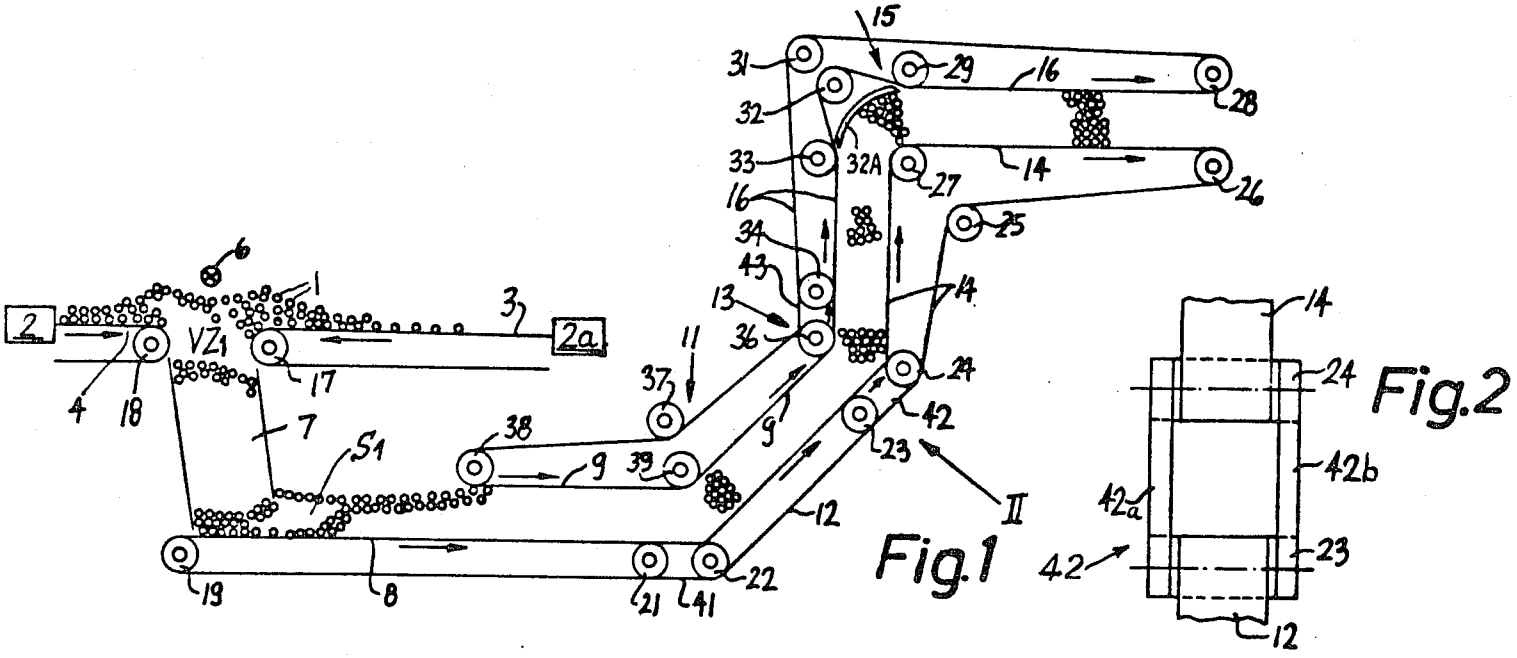
FIG. 1 is a schematic elevational view of a portion of a first apparatus, showing two producing machines and the means for transporting articles from the producing machines to a channel which delivers the articles to a processing machine.
FIG. 2 is an enlarged view of an intermediate conveyor of the transporting means, as seen in the direction of arrow II in FIG. 1.
Figure 3:
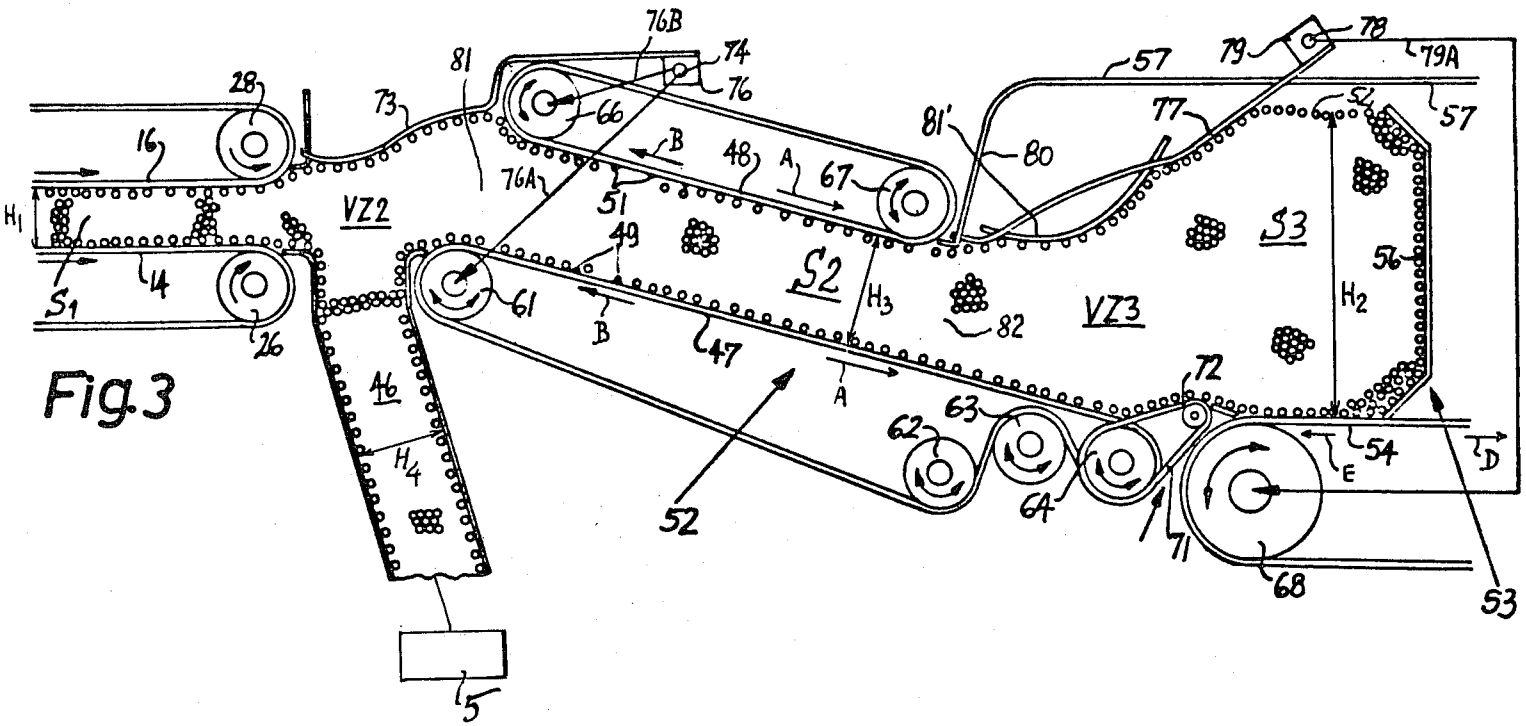
FIG. 3 is an enlarged schematic elevational view of the remaining portion of the apparatus, showing the processing machine, the intermediate reservoir and the associated surge bin.

Referring first to FIGS. 1 to 3, there is shown an apparatus which serves for transport and temporary storage (when necessary) of cigarettes 1 issuing from two producing machines 2 and 2*a* (each of these machines may constitute a maker of plain cigarettes or a machine for the production of filter cigarettes) and intended to be processed in one or more processing or consuming machines 5. The machine 5 is assumed to constitute a conventional variable-capacity packing machine having a magazine which normally receives the output of the machines 2 and 2*a*. The capacity of the machine 2 and/or 2*a* also varies, e.g., these machines can be operated at several speeds or one or both producing machines can be deactivated due to malfunction, in order to replace reels of cigarette paper and/or for other reasons. The term "variable-capacity", as used in the description and in the claims, is intended to denote changes in the output between zero output and maximum output (in connection with the producing machines 2 and 2*a*) and changes in requirements between zero requirements and maximum requirements (in connection with the processing machine 5). It is further clear than the number of producing machines can be reduced to one or increased to three or more, and that the number of processing machines can be increased to two or more. The producing machines may be of the type known as "GARANT" (trademark) produced by the assignee of the present application, and the processing machine may be any one of the packing machines produced by the assignee of the present application.

The means for transporting cigarettes 1 from the outlets of the producing machines 2 and 2*a* and along an elongated path whose discharge end is shown in FIG. 3, as at VZ2, is illustrated in FIGS. 1 and 2. The transporting means comprises two endless belt conveyors 3 and 4 which respectively deliver the outputs of the machines 2*a* and 2 to a junction VZ1 where the cigarettes form a downwardly moving column in a substantially upright duct 7. The cigarettes 1 move sideways and normally form single layers immediately downstream of the outlets of the respective producing machines. Such single layers are converted into streams consisting of two or more superimposed layers on their way toward the junction VZ1, i.e., toward the inlet at the upper end of the duct 7. A photoelectronic monitoring device 6 is provided at a predetermined level about the junction VZ1 and is operatively connected with the prime mover means (not shown) for the producing machines 2, 2*a* to reduce the output of or to arrest one or both producing machines when the upper end of the column of cigarettes 1 rises to a predetermined level.

The transporting system of FIGS. 1 and 2 further comprises an endless belt conveyor 8 whose upper reach is at least substantially horizontal and serves to advance a multi-layer stream S1 of cigarettes 1 from the lower end of the duct 7 toward a first direction changing station 11. On its way toward the station 11, the uppermost layer of cigarettes 1 forming the stream S1 advances below and is (or can be) engaged by the lower reach of an endless belt conveyor 9 which extends to both sides of the station 11. That portion of the lower reach of the conveyor 9 which is located downstream of the station 11 cooperates with the upper reach of a further endless belt conveyor 12 to advance the stream S1 along an upwardly inclined portion of the path and on to a second direction changing station 13 where the stream S1 enters the lower end of a substantially vertical portion of the path between the adjacent reaches of two further endless belt conveyors 14 and 16. The conveyors 14 and 16 extend to both sides of a third direction changing station 15 where the stream S1 enters a horizontal or nearly horizontal portion of the path, and such horizontal portion extends all the way to the discharge end VZ2.

A first composite intermediate belt conveyor 41 is disposed between the conveyors 8 and 12 to assist the stream S1 in changing the direction of its movement from the horizontal to the upwardly inclined portion of its path. A similar intermediate conveyor 42 is installed between the conveyors 12, 14, and a further intermediate conveyor 43 is installed between the conveyor 9 and 16. The construction of the intermediate conveyor 42 is shown in FIG. 2; its belts 42*a*, 42*b* flank the adjacent end portions of the conveyors 12 and 14. A suitably configurated deflector or baffle 32A is mounted at the direction changing station 15 to insure predictable changes in the direction of movement of successive increments of the stream S1 while simultaneously preventing undesirable changes in orientation of cigarettes which form the upper layer or layers of the stream.

The reference characters 17–19, 21–29, 31–34 and 36–39 designate pulleys for the aforedescribed belt conveyors. Such pulleys will be replaced by sprocket wheels if the belt conveyors are replaced with chains or other suitable endless flexible elements.

The region between the duct 7 and pulley 38 for the left-hand end turn of the belt conveyor 9 can be utilized as an inspection zone where an attendant removes obviously defective or defaced cigarettes 1 and changes the orientation of those cigarettes which lie askew.

The means for driving the conveyors of the transporting means which defines the first path (between the producing machine or machines and the discharge end VZ2) is not shown in the drawing. The operation of driving means is such that all of the conveyors are driven in synchronism in order to avoid damage to and/or defacing of cigarettes, especially at the stations 11, 13, 15 and at both ends of the duct 7.

The discharge end VZ2 normally delivers the stream S1 to the inlet of a vertical or nearly vertical channel 46 which, in turn, delivers the cigarettes 1 to the magazine of the processing machine 5 by moving the cigarettes sideways along a vertical or nearly vertical path. The height H4 of the channel 46 is such that it can receive and convey a multi-layer stream of cigarettes. When the channel 46 is filled to capacity and cannot accept any additional cigarettes, the cigarettes of the stream S1 are admitted into an intermediate reservoir 52 having an inlet-output opening 81 in communication with the first path (namely, with the discharge end VZ2) and with the inlet at the upper end of the channel 46. The means for conveying cigarettes from the discharge end VZ2 into and beyond the opening 81 comprises two endless belt conveyors 47 and 48. Those sides of the conveyors 47 and 48 which engage the cigarettes 1 are respectively provided with transversely extending rungs, ribs or analogous entraining elements 49 and 51 to insure positive advancement of cigarettes into and beyond the reservoir 52. However, the entraining elements 49 and 51 are optional.

The conveyors 47 and 48 serve as a means for conveying a multi-layer stream S2 of cigarettes 1 from the inlet-outlet opening 81 of the intermediate reservoir 52 to the inlet-outlet opening 82 of a second or main reservoir 53 (hereinafter called surge bin) wherein the cigarettes form a stack S3. It will be noted that the height (H2) of the stack S3 exceeds the height (H3) of the space or passage between the conveyors 47, 48 and the height (H1) of the space or passage between the conveyors 14, 16. On the other hand, the height H3 exceeds the height H1 and preferably also the height (actually width) H4 of the channel 46.

The surge bin 53 comprises an endless belt conveyor 54 having a horizontal or nearly horizontal upper reach which constitutes the bottom wall of the surge bin and is movable back and forth in directions toward and away from the inlet-outlet opening 82. The upper reach of the conveyor 54 carries an upwardly extending end wall 56 which shares the movements of the conveyor 54 to advance toward the opening 82 (and to thereby reduce the volume of the surge bin 53) or in the opposite direction (to thereby increase the volume of the surge bin). The surge bin 53 further comprises a cover 57 which shields the stack S3 from dust.

The reference characters 61–64 and 66–68 denote pulleys for the conveyors 47, 48 and 54. The transfer zone VZ3 between the interior of the surge bin 53 and the interior of the intermediate reservoir 52 is located above an intermediate belt conveyor 71 which is trained over the pulley 64 and an additional pulley 72 so that its upper reach slopes upwardly from the level of the adjacent portion of the conveyor 47 to a level slightly above the upper reach of the conveyor 54. It has been found that the intermediate conveyor 71 (or an analogous hump) facilitates the merger of successive increments of the stream S2 into the stack S3.

A mobile sensor 73 monitors the height of the supply of cigarettes 1 in the area between the discharge end VZ2, inlet-outlet opening 81 of the intermediate reservoir 52 and the inlet of the channel 46. The sensor 73 rests on top of the uppermost layer of cigarettes and moves up and down in response to fluctuations of the supply of cigarettes at the discharge end VZ2. The purpose of the sensor 73 is to transmit signals to a drive 76 for the left-hand pulleys 61, 66 of the conveyors 47 and 48. The drive 76 is reversible and receives signals from a shaft 74 which defines a pivot axis for and turns with the sensor 73. The exact nature of the reversible drive 76 forms no part of the present invention (the operative connections between this drive and the pulleys 61, 66 are respectively denoted by arrows 76A, 76B). It suffices to say that the drive 76 causes the conveyors 47, 48 to advance in directions indicated by arrows A when the cigarettes 1 lift the sensor 73 to or above a predetermined level, and that the conveyors 47, 48 are caused to advance cigarettes from the surge bin 53 toward the inlet of the channel 46 (arrows B) when the sensor 73 sinks below such level. The drive 76 is of the on-and-off type and is assumed to move the conveyors 47, 48 at a constant speed. However, it is equally possible to employ a variable-speed reversible drive which is controlled by a potentiometer (which, in turn, is controlled by the sensor 73 or by a battery of photoelectric sensors) to drive the belts 47, 48 at a variable speed, either in the directions indicated by arrows A or in the directions indicated by arrows B, depending upon whether or not the sensor 73 is located above or below a certain level.

The means for effecting movements of the conveyor 54 of the surge bin 53 in directions indicated by arrows D and E includes a second monitoring device having a sensor 77 which is pivotable at 78 and rests on the topmost layer of cigarettes 1 in the transfer zone VZ3. The sensor 77 transmits signals to a reversible drive 79 which is operatively connected with the pulley 68 for the conveyor 54 (the operative connection is indicated by the arrow 79A). A stationary sheet metal wall 80 extends downwardly from the left-hand end of the cover 57 to the level of the lower reach of the conveyor 48 to promote or facilitate gradual reduction of the height of the supply of cigarettes 1 from the level of the uppermost layer of the stack S3 to the level of the uppermost layer of the stream S2 and vice versa, depending on the direction of movement of the conveyors 47 and 48. The sensor 77 insures that the variable-volume surge bin 53 is always filled to capacity, i.e., that the height H2 of the stack S3 fluctuates little or not at all.

The drive 79 for the conveyor 54 can be operated continuously or intermittently and can move the conveyor 54 at a constant speed or at a variable speed, substantially in the same way as described in connection with the drive 76 for the conveyors 47 and 48.

The sensor 77 is relatively long. Therefore, the upper region of the zone VZ3 would be likely to develop empty spaces and the cigarettes below and around the empty spaces (especially immediately below the sensor 73) would be likely to change their orientation and thereby interfere with orderly transport of cigarettes into and from the surge bin 53. Therefore, the sensor 77 carries a pivotable compensating plate 81' which may consist of several articulately connected sections or is sufficiently flexible to overlie the uppermost layer of cigarettes 1 in the zone VZ3 and to thus prevent any changes in orientation of adjacent cigarettes. The illustrated compensating device has a convex underside. It has been found that the compensating device 81' greatly reduces the likelihood of misorientation of cigarettes below the sensor 77. It goes without saying that a similar compensating device can be provided on or associated with the sensor 73.

The upper belt conveyor 48 of the conveying means in the intermediate reservoir 52 is optional. Thus, this conveyor can be omitted so that the pulleys 66, 67 or similar rotary members respectively contact the cigarettes 1 in the regions of the openings 81 and 82. In other words, it normally suffices to control the height of the stream S2 in the region of the discharge end VZ2 and in the region of the transfer zone VZ3. If the conveyor 48 is omitted, the distance between the rotary member 66 and the upper reach of the conveyor 47 preferably equals the distance between this upper reach and the rotary member 67. It is further within the purview of the invention to replace the inclined conveyors 47, 48 with horizontal conveyors so that the passage between the conveyors 47, 48 is aligned with the passage between the conveyors 14, 16 immediately upstream of the discharge end VZ2. By the same token, the inclination of downstream portions of the conveyors 14, 16 can be changed so as to conform to or approximate the inclination of the passage between the conveyors 47 and 48.

Figures 4, 5:
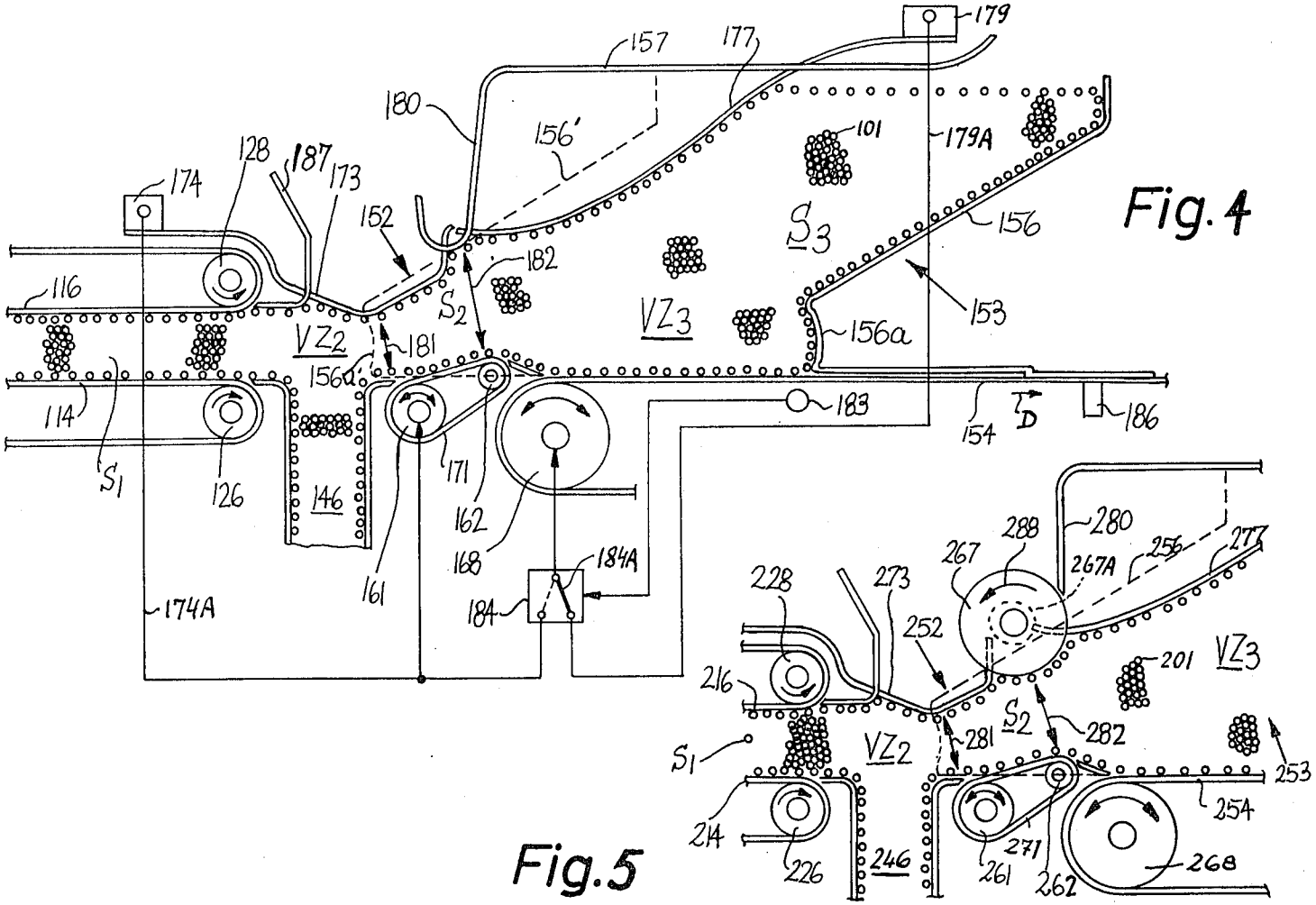
FIG. 4 is a fragmentary schematic elevational view of a second apparatus with a modified reservoir and a modified surge bin.
FIG. 5 is a fragmentary schematic elevational view of an apparatus which constitutes a modification of the apparatus of FIG. 4.

FIG. 4 illustrates a portion of a modified apparatus wherein all such parts which are identical with or clearly analogous to corresponding parts of the apparatus of FIGS. 1 to 3 are denoted by similar reference characters plus 100. The channel 146 is vertical, and the intermediate reservoir 152 differs from the reservoir 52 in several respects including the omission of the upper conveyor (which, if provided, would be a functional equivalent of the conveyor 48 of FIG. 3). In fact, the intermediate reservoir 152 can be said to constitute an antechamber of the main reservoir or surge bin 153. The height of the passage which is defined by the reservoir 152 increases in a direction from the inlet-outlet opening 181 toward the inlet-outlet opening 182, i.e., in a direction from the discharge end VZ2 of the path defined by the transporting system including the belt conveyors 114, 116 toward the surge bin 153. The conveying means of the intermediate reservoir 152 includes a single endless belt conveyor 171 which is the mobile bottom wall of the reservoir 152 and slopes upwardly from the level of the inlet at the upper end of the channel 146 to a level above the upper reach (bottom wall) of the endless belt conveyor 154 of the surge bin 153. The upper reach of the conveyor 171 loosens the stream S2 of cigarettes 101 during transport in a direction to the right, as viewed in FIG. 4. The direction in which the conveyor 171 is driven is determined by monitoring means including a sensor 173 which rests on the topmost layer of the supply of cigarettes 101 at the discharge end VZ2 and generates signals to control the operation of a reversible drive 174 for the pulley 161. The operative connection between the drive 174 and the shaft for the pulley 161 is indicated by the line 174A. The sensor 173 constitutes a top wall or cover of the reservoir 152.

The monitoring means in the transfer zone VZ3 includes a second sensor 177 which transmits signals to a drive 179 for the pulley 168, i.e., for the conveyor 154 of the surge bin 153. The operative connection is indicated by the line 179A. In addition, the pulley 168 can receive motion from the drive 174 through the medium of a switchover device 184 (e.g., a two-position switch) having a movable contact 184A which can be shifted between the solid-line and broken-line positions of FIG. 4. The means for changing the positions of movable contact 184A comprises a proximity switch 183 which is adjacent to the path of movement of a trip 186 mounted on and extending downwardly from the upper reach of the conveyor 154.

The mobile end wall 156 of the surge bin 153 has a lower portion 156*a* which is substantially vertical and can enter the passage defined by the intermediate reservoir 152 to expel cigarettes 101 into the inlet of the channel 146 when the wall 156 assumes its left-hand end position (indicated by broken lines, as at 156'). The corresponding end position of the lower portion 156*a* is shown at 156*a'*. The location of the proximity switch 183 is selected in such a way that the movable contact 184A moves to the broken-line position when the lower portion 156*a* of the mobile wall 156 reaches an intermediate position close to the inlet-outlet opening 182. From there on, the pulley 168 receives torque from the drive 174 via operative connection 174A. The movements of the end wall 156 from the just mentioned intermediate position (the portion 156*a* located in or close to the opening 182) to the right-hand end position are initiated by the drive 179 in response to signals from the sensor 177. In other words, the drive 174 initiates the movements of pulleys 161, 168 while the lower portion 156*a* of the mobile wall 156 is located in the intermediate reservoir 152, and the drives 174, 179 respectively control the movements of the pulleys 161, 168 when the portion 156*a* is located in the surge bin 153.

An important advantage of the apparatus of FIG. 4 is that, when the reservoir 152 is empty (i.e., when the lower portion 156*a* of the mobile wall 156 is held in the end porition 156*a*'), the cigarettes 101 which advance from the discharge end VZ2 into the inlet of the channel 146 need not travel along cigarettes which fill or partially fill the passage of the intermediate reservoir. In other words, the reservoir 152 is empty and all cigarettes 101 advancing from the first path into the second path (i.e., from the passage between the conveyors 114, 116 into the channel 146) merely slide along the suitably configurated left-hand side of the portion 156*a*. The likelihood of damage to cigarettes in the intermediate reservoir is especially pronounced if the mobile end wall of the surge bin is idle for extended periods of time, i.e., (and referring to FIG. 3) when the conveyors 47, 48 of FIG. 3 remain at a standstill and the cigarettes 1 moving from the conveyor 14 into the channel 46 brush past the cigarettes in the passage of the reservoir 52.

When the output of the producing machine or machines exceeds the requirements of the processing machine, i.e., when the surplus is admitted into the intermediate reservoir 152 and thence into the surge bin 153, the trip 186 moves in a direction to the right (arrow D) and toward and past the proximity switch 183. The movable contact 184A then returns to the solid-line position of FIG. 4 and the shaft of the pulley 168 receives torque from the drive 179.

The sensors 173 and 177 are preferably forked so that they can move with respect to the adjacent stationary walls 187 and 157, 180. This insures that the cigarettes 101 at the discharge end VZ2 cannot spill over the conveyor 116 and that the sensor 177 can follow the downward movement of the uppermost layer of cigarettes 101 in the transfer zone VZ3. The mobile wall 156 also comprises prongs so that it can bypass the sensor 177 and wall 180 during movement toward the end position 156'.

As mentioned above, the intermediate reservoir 152 is empty when the wall 156 assumes the left-hand end position 156'. When the reservoir 152 is partially filled, the likelihood of damage to cigarettes 101 therein is reduced by imparting to the passage between the sensor 173 and the upper reach of the conveyor a configuration such that the height of this passage increases in a direction from the opening 181 toward the opening 182. Thus, the number of cigarettes 101 which are adjacent to the stream S1 advancing from the discharge end VZ2 into the channel 146 is relatively small. The height of the passage in the region of the opening 181 can be less than the height of the stream S1 and appreciably less than the height of the same passage in the region of the opening 182. The height of the passage in the region of the opening 182 is considerably less than the height of the stack S3 in the surge bin 153.

FIG. 5 shows an apparatus which constitutes a modification of the apparatus of FIG. 4. All such parts which are identical with or clearly analogous to corresponding parts of the apparatus of FIG. 4 are designated by similar reference characters plus 100. A driven roller or drum 267 above the inlet-outlet opening 182 of the surge bin 253 can be rotated in the direction indicated by arrow 288, i.e., in a direction to promote the advancement of cigarettes 201 from the intermediate reservoir 252 in the surge bin 253. The periphery of the roller 267 engages the topmost layer of the stream S2 during movement of such stream into the surge bin 253. It has been found that the roller 267 facilitates the merger of successive increments of the stream S2 into the stack of cigarettes in the surge bin. The one-way clutch which transmits torque to the roller 267 is indicated at 267A. This clutch is controlled by the drive for the conveyor 271 when the latter advances cigarettes 201 toward the interior of the surge bin 253. When the conveyor 271 moves in a direction to evacuate the contents of the surge bin 253, the roller 267 remains idle.

Figures 6, 7:
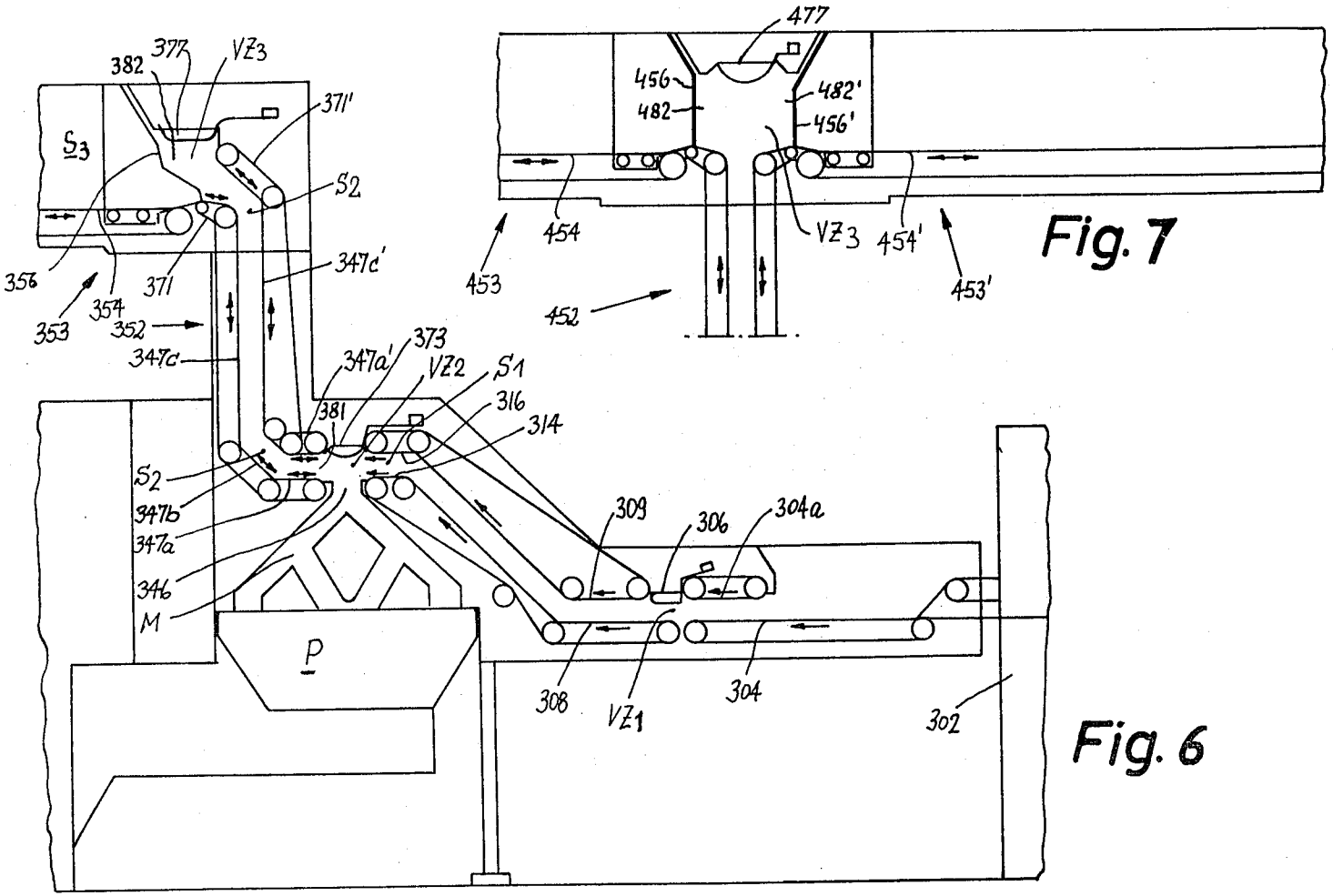
FIG. 6 is a schematic elevational view of a fourth apparatus wherein the major part of the intermediate reservoir is vertical.
FIG. 7 is a fragmentary schematic elevational view of a fifth apparatus with two surge bins.

The apparatus of FIG. 6 comprises a transporting system which advances a stream S1 of cigarettes (not specifically shown) from a single producing machine 302 to a channel 346 serving to deliver cigarettes into the magazine M of a packing machine P. All such parts of the apparatus of FIG. 6 which are identical with or clearly analogous to corresponding parts of the apparatus of FIGS. 1 to 3 are denoted by similar reference characters plue 300. The aforementioned transporting system of the apparatus of FIG. 6 advances the stream S1 from a lower level (of the outlet of the producing machine 302) to a higher level, namely, to the level of the inlet at the upper end of the channel 346. This transporting system comprises two belt conveyors 304, 304*a* which advance cigarettes from the outlet of the machine 302 to a junction VZ1 where the stream S1 is taken over by two further endless belt conveyors 308, 309. The space between the conveyors 304*a*, 309 accommodates a sensor 306 which rests on the stream S1 and controls the drive means for the conveyors 308, 309. The conveyors 308, 309 transport the stream S1 along an upwardly sloping portion of the first path and into a horizontal portion between additional endless belt conveyors 314, 316 which, in turn, advance the stream S1 all the way to the discharge end VZ2 of the first path. This discharge end communicates with the inlet of the second path, namely, with the upper end of the channel 346. The second path is relatively short, i.e., the discharge end VZ2 of the first path is located slightly above the level of the magazine M of the processing machine P.

The aforementioned endless belt conveyor 304*a* cooperates with the belt conveyor 304 to convert a single layer or cigarettes which issue from the producing machine 302 into a multi-layer stream S1. It is clear that the producing machine 302 can turn out other types of rod-shaped articles which constitute or form part of smokers' products. For example, if the machine 302 produces filter rod sections, the illustrated processing machine P is replaced with a pneumatic sender which transports filter rod sections to one or more remote filter cigarette making machines.

In accordance with a feature of the apparatus of FIG. 6, the intermediate reservoir 352 extends vertically or substantially vertically upwardly from the discharge end VZ2 of the first path. Thus, the inlet-outlet opening 381 of the reservoir 352 is located at a level below the vertical portion of the path along which a second stream S2 moves upwardly from the discharge end VZ2 when the machine P cannot accept the entire output of the machine 302, and along which the stream S2 moves downwardly toward the inlet of the channel 346 when the machine 302 cannot satisfy the requirements of the machine P.

The intermediate reservoir 352 comprises two endless belt conveyors 347*a*, 347*a*' which define the inlet-outlet opening 381, an intermediate endless belt conveyor 347*b* which changes the direction of movement of the stream S2 from horizontal to vertical or vice versa, two vertical belt conveyors 347*c*, 347*c'* which define the aforementioned vertical portion of the path for the stream S2, and two divergent endless belt conveyors 371, 371' which admit the stream S2 into the transfer zone VZ3, i.e., to the inlet-outlet opening 382 of the surge bin 353.

A pivotable sensor 373 is installed between the conveyors 316, 347*a'* and rests on the uppermost layer of cigarettes at the discharge end VZ2. When the sensor 373 assumes a neutral or median position, the drive for the conveyors 347*a*, 347*a'*, 347*b*, 347*c*, 347*c'* is idle. If the sensor 373 is lifted above such neutral position, the conveyors 347*a*–347*c'* are caused to advance the stream S2 from the discharge end VZ2 toward the transfer zone VZ3. If the sensor 373 descends below the neutral position, the conveyors 347*a*–347*c'* are driven in the opposite direction to transport cigarettes from the surge bin 353 to the inlet of the channel 346.

The endless belt conveyor 354 (whose upper reach constitutes the bottom wall of the surge bin 353) carries a mobile end wall 356 which resembles the end wall 256 of FIG. 5 and is driven by a prime mover which is controlled by a sensor 377 mounted above the transfer zone VZ3 and resting onto the uppermost layer of cigarettes therebelow. The sensor 377 causes the conveyor 354 to move the end wall 356 away from the opening 382 when the height of the pile of cigarettes in the transfer zone VZ3 increases, and vice versa. The volume of the surge bin 353 varies as a function of the quantity of cigarettes therein and the height of the stack S3 of cigarettes therein is greater than the height of the stream S1 or S2.

An important advantage of the apparatus of FIG. 6 is that the outlet of the producing machine 302 can be placed very close to the magazine M of the processing machine P. Moreover, the apparatus can employ a large surge bin because the latter is located at a level well above the magazine M so that it occupies space which is normally available in a tobacco or filter material processing plant.

FIG. 7 shows a portion of an apparatus wherein the intermediate reservoir 452 delivers a stream of cigarettes or the like to two preferably mirror symmetrical surge bins 453 and 453'. The inlet-outlet openings 482, 482' of these surge bins respectively admit cigarettes to or permit evacuation of cigarettes from a common transfer zone VZ3 below a pivotable sensor 477 which controls the drive means for the endless belt conveyors 454, 454' of the surge bins 453, 453'. The arrangement is such that, when the conveyors of the intermediate reservior 452 deliver cigarettes to the transfer zone VZ3, the conveyors 454, 454' move the respective end walls 456, 456' away from the respective openings 482, 482' so that the volume of the surge bin 453 increases at the same rate as the volume of the surge bin 453'. The same applies when the processing machine must receive cigarettes from the surge bins, i.e., the volumes of both surge bins decrease at the same rate. It is also within the purview of the invention to fill or evacuate the contents of one surge bin prior to filling or emptying of the other surge bin; however, simultaneous filling or emptying of both surge bins is preferred at this time because it is less likely to adversely influence the shape and/or other characteristics of cigarettes which are lifted into or descend from the transfer zone VZ3.

In each of the illustrated apparatus, the height of the passage defined by the intermediate reservoir can decrease in a direction toward the inlet-outlet opening(s) of the surge bin(s), and the height of the surge bin or bins can decrease in a direction toward the transfer zone VZ3.

An important advantage of all illustrated and described embodiments of the apparatus is that the height of the stack S3 in each surge bin can greatly exceed the height of the stream S2, and also that the provision of intermediate reservoir with its conveying means insures gentle treatment of cigarettes which advance from the first into the second path because the surplus (if any) need not be introduced into the surge bin(s) directly from the first path but rather by way of the intermediate reservoir wherein the height of the tobacco stream (S2) need not appreciably exceed the height of the stream S1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for transporting cigarettes or analogous rod-shaped articles which constitute or form part of smokers' products from at least one variable-capacity producing machine to at least one variable-capacity consuming machine, comprising means for transporting a multi-layer stream of articles from the producing machine along a first path having a discharge end; a conveying device including a channel having a receiving end at said discharge end and defining a second path for delivery of articles of said multi-layer stream to the consuming machine, the cross-sectional area of said channel being such that the articles therein form a multi-layer stream; at least one variable-volume surge bin having a first inlet-outlet opening for admission of articles into or for evacuation of articles from its interior, said surge bin comprising a reciprocable bottom wall and an end wall extending upwardly from and movable with said bottom wall toward and away from said first opening to thereby respectively reduce and increase the volume of said surge bin; means for monitoring the upper level of the article layer in the region of said first opening, said monitoring means being installed at a predetermined distance from said bottom wall; means for moving said end wall away from and toward said first opening when the monitored level respectively rises and falls; sensor means adjacent to said discharge end and movable between a plurality of positions each indicative of a different ratio of the rate of transport of articles along said first path to the rate of delivery of articles along said second path; an intermediate reservoir communicating with said first opening and having a second inlet-outlet opening adjacent to said first path, said reservoir including means for conveying articles from said surge bin to said first path for introduction into said receiving end when the requirements of the consuming machine exceed the output of the producing machine and for conveying articles from said first path into said surge bin when the output of the producing machine exceeds the requirements of the consuming machine, said second opening being in communication with said discharge end and with said receiving end to admit articles from said discharge end into said reservoir when the output of the producing machine exceeds the requirements of the consuming machine and to admit articles into said receiving end when the requirements of the consuming machine exceed the output of the producing machine; and drive means for operating said conveying means in dependency on the position of said sensor means so as to advance articles from said surge bin to said first path when said ratio decreases and to advance articles from said first path into said surge bin when said ratio increases.

2. Apparatus as defined in claim 1, wherein said conveying means comprises a first endless flexible conveyor adjacent to said second opening and a second endless flexible conveyor disposed intermediate said first conveyor and said first opening, said conveyors having article-engaging reaches and said reach of said second conveyor being inclined with respect to said reach of said first conveyor and said bottom wall.

3. Apparatus as defined in claim 1, wherein said sensor means includes a portion which rests on the stream at the discharge end of said path.

4. Apparatus as defined in claim 1, wherein said monitoring means includes a sensor having a movable portion resting on the article stream in the region of said first opening so that said portion respectively moves up and down when the height of such stream respectively increases and decreases.

5. Apparatus as defined in claim 4, further comprising compensating means for opposing changes in orientation of articles in the region of said first opening, including an article-contacting element articulately connected with said sensor.

6. Apparatus as defined in claim 1, wherein said conveying means comprises a driven endless flexible conveyor constituting a mobile bottom wall for said reservoir, said bottom walls of said reservoir and said surge bin being inclined with respect to each other.

7. Apparatus as defined in claim 1, wherein said first path has a first height and said surge bin has a second height exceeding said first height, said reservoir having in the region of said first inlet-outlet opening a third height which is less than said second height and less than said distance but exceeds said first height.

* * * * *